US008118164B2

(12) United States Patent
Brown

(10) Patent No.: US 8,118,164 B2
(45) Date of Patent: Feb. 21, 2012

(54) PRODUCT DISPLAY ASSEMBLY HAVING INCREASED STABILITY

(75) Inventor: Christopher Alan Brown, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 274 days.

(21) Appl. No.: 12/197,562

(22) Filed: Aug. 25, 2008

(65) Prior Publication Data

US 2010/0044250 A1 Feb. 25, 2010

(51) Int. Cl.
*B65D 19/00* (2006.01)

(52) U.S. Cl. ..... 206/386; 40/606.15

(58) Field of Classification Search ..... 206/386, 206/600; 40/606.15, 610, 611.02, 539
See application file for complete search history.

(56) References Cited

U.S. PATENT DOCUMENTS

| | | | | |
|---|---|---|---|---|
| 4,042,127 | A * | 8/1977 | Brossia | 206/386 |
| 4,049,113 | A * | 9/1977 | Joyce et al. | 206/45.22 |
| 4,222,187 | A * | 9/1980 | Huck | 40/649 |
| 4,492,580 | A * | 1/1985 | Sabel | 434/127 |
| 4,705,162 | A * | 11/1987 | Kupersmit | 206/745 |
| 4,919,270 | A * | 4/1990 | Govang et al. | 206/597 |
| 5,251,753 | A | 10/1993 | Pigott et al. | |
| 5,350,066 | A * | 9/1994 | Mendoza et al. | 206/386 |
| 5,704,488 | A * | 1/1998 | Smith | 206/598 |
| 5,896,995 | A * | 4/1999 | Murray et al. | 206/736 |
| 6,164,900 | A | 12/2000 | Labell et al. | |
| 6,267,255 | B1 * | 7/2001 | Brush | 211/59.4 |
| 6,594,970 | B1 | 7/2003 | Hyne et al. | |
| 6,925,943 | B2 | 8/2005 | Salmanson et al. | |
| 6,944,928 | B1 | 9/2005 | Johansson | |
| 6,955,128 | B2 | 10/2005 | Apps | |
| 7,007,613 | B2 | 3/2006 | Sketo | |
| 7,086,339 | B2 | 8/2006 | Apps et al. | |
| 7,086,340 | B2 | 8/2006 | Apps et al. | |
| 7,124,897 | B2 | 10/2006 | Bustos | |
| 7,159,521 | B2 | 1/2007 | Salmanson et al. | |
| 7,165,499 | B2 | 1/2007 | Apps et al. | |
| 7,325,500 | B2 | 2/2008 | Carpenter et al. | |
| 7,360,493 | B2 | 4/2008 | Hummel et al. | |
| 7,383,951 | B2 | 6/2008 | Smolenski et al. | |
| 7,546,703 | B2 * | 6/2009 | Johnske et al. | 40/539 |

FOREIGN PATENT DOCUMENTS

DE 201 11 088 U1 12/2001

OTHER PUBLICATIONS

International Search Report and Written Opinion (WO 2010/027769).

* cited by examiner

*Primary Examiner* — Jacob K Ackun
(74) *Attorney, Agent, or Firm* — Christian M. Best; Roddy M. Bullock

(57) ABSTRACT

A product display assembly having an x-axis, y-axis, z-axis, x-y-plane, x-z-plane, and y-z plane. The product display assembly also having a base, a plurality of product packages having a product space, and a support stem. The support stem also has one or more hingedly attached flaps wherein the one or more flaps are foldable to extend beyond the product space.

20 Claims, 19 Drawing Sheets

PRODUCT DISPLAY ASSEMBLY HAVING INCREASED STABILITY

FIELD OF THE INVENTION

This invention relates generally to a display, and more specifically to a product display assembly that provides increased stability and visibility to the product while on the display.

BACKGROUND OF THE INVENTION

A number of challenges arise in the area of product transport and display. Typically, a plurality of packed products are loaded onto a support medium (for example, a pallet), overwrapped, loaded onto a truck, transported to a retail location and, in the case of club stores, the pallet display assembly is then simply placed on the retail floor and unwrapped for customers to purchase.

One of the components of a wrapped product pallet is a pallet cover which is used to shield the product packages on a first pallet from the effects of having a second pallet stacked on top of the first pallet. In many instances, the pallet cover is simply a piece of cardboard which is simply removed and discarded from the pallet and product packages once the product arrives at the retail location.

In addition, in many retail settings, and especially in club store-type settings, a product display assembly may not be visible to the consumer from a relatively far distance because many other products are. Specifically, when a consumer is looking at a series of palletized products from a distance, the standardized width and height of a palletized product often fails to allow one product to stand out from each other. The addition of additional components to a pallet in order to draw attention to the pallet from a distance may be possible.

Retailers have a vested interest in optimizing the stability and visibility of a product display assemblies impact product revenue, manufacturers and retailers have a vested interest in displaying product packages in the most effective way possible. That being said, presenting and maintaining effective displays may provide obstacles for a retailer. For instance, because many product display assemblies involve the stacking of a plurality of packages, the inclusion of an overly elaborate display component to a product display assembly may cause the product display assembly to be relatively unstable. Further, in-store compliance with an elaborate product display assembly may be an issue. A retailer may be hesitant to require its employees to spend an inordinate amount of time to set up a product display assembly. As a result, an elaborate product display assembly may go unassembled or elements of an older, simpler, product display for the same product may be reused to avoid the extra work associated with assembling a newer, more complicated, product display. Consequently, the retailer and producer may unintentionally fail to give the consumer the best possible first-impression of a product as possible.

Thus, there exists the need for a system and method of effectively displaying product packages such that provides a relatively high level of support to the packages, provides a relatively high visual appeal/high level of visibility to consumers, and is relatively easy to set up (allows for a relatively high level of in-store compliance) that minimizes the amount of extraneous materials to provide cost savings to the producer, and eventually the consumer.

SUMMARY OF THE INVENTION

In one nonlimiting embodiment, the present invention is directed to a product display assembly having an x-axis, y-axis, z-axis, x-y-plane, x-z-plane, and y-z plane. The product display assembly further comprises a base, a plurality of product packages having a product space, and a support stem. The support stem further comprises one or more hingedly attached flaps wherein the one or more flaps are foldable to extend beyond the product space.

In another nonlimiting embodiment, the present invention is directed to a support stem for a product display assembly. The support stem has an x-axis, y-axis, z-axis, and x-z plane. The support stem comprises one or more hingedly attached flaps and the one or more flaps are extendable to be substantially coplanar with the x-z plane of the support stem.

In yet another nonlimiting embodiment, the present invention is directed to a method for marketing a palletized product wherein the method comprises the steps of: (a) providing a pallet; (b) providing a plurality of product packages on the pallet; wherein the plurality of product packages define a product space; (c) providing a support stem between at least two of the plurality of product packages; wherein the support stem further comprises one or more hingedly attached flaps that are extendable beyond the product space; (d) providing an outer wrap around the plurality of packages and the support stem; and (e) delivering the palletized product packages to a retail location to display the product packages.

DETAILED DESCRIPTION

Figure 1A:
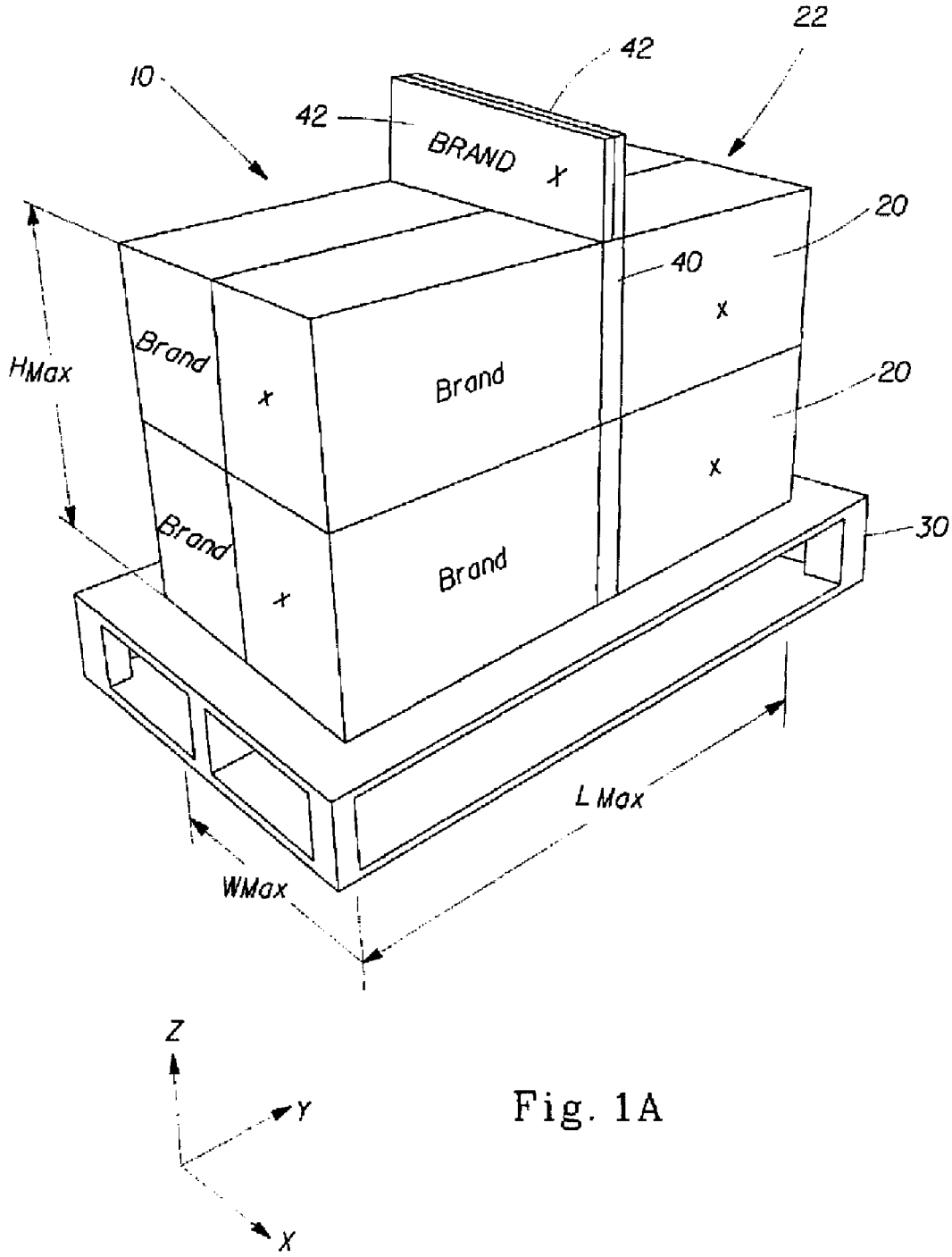
FIG. 1A is a perspective view of an exemplary product display assembly according to the present invention.

As defined herein, "product display assembly" or "pallet display assembly" refers to a group of components that may be used to store, transport, and/or consumer product packages. In one embodiment, a product display assembly of the present invention comprises a base, a plurality of consumer products or consumer product packages, and a support stem. In another embodiment, a product display assembly may further comprise a plastic overwrap or any other outer covering known to one of skill in the art. One of skill in the art may appreciate that an overwrap may be used to secure a plurality of products or product packages on a base during transport.

As defined herein, "product space" refers to the available volume of space to be occupied by one or more product packages in a product display assembly. The product space comprises a maximum length boundary, maximum width boundary, and maximum height boundary—all of which may be defined by the total length, width and height, respectively, of the plurality of product packages in the product display assembly.

As defined herein, "base" refers to a supporting medium for a product, product package, or plurality of products or product packages. In one embodiment, a base is a pallet. In another embodiment, a base is a retail shelf unit. In yet another embodiment the base is a shelf tray.

As defined herein, "product" refers to any article or item which may be supported on a base. In a first exemplary embodiment the product may be a laundry product such as a laundry detergent and/or fabric softener. In one embodiment, a product refers to a consumer paper product which may be selected from the group consisting of: disposable absorbent articles, bathroom tissue, napkins, paper towel products, facial tissues, wipes, the like, and combinations thereof. In another embodiment, a product refers to a feminine care product which may be selected from the group consisting of: disposable absorbent articles, sanitary napkins, tampons, interlabial products, incontinence articles, liners, the like, and combinations thereof. In another embodiment, a product refers to a baby care product which may be selected from the group consisting of: disposable absorbent articles, diapers, training pants, incontinence articles, wipes, the like, and combinations thereof.

As defined herein, "product packaging" refers to any container, package or other suitable enclosure for one or more products. In one embodiment, a product packaging comprises an overwrap. In another embodiment, a product package comprises a box or carton. In another embodiment still, a product package comprises a plastic container.

As defined herein, "product package" refers to any one or more products enclosed in any one or more product packaging media. In an embodiment of the invention, product packages in a product display assembly may be selected from the group consisting of: product packages of different sizes, product packages containing different products, product packages having different counts of the same product, product packages having different product sizes, and combinations thereof. In still another embodiment, product packages in a product display assembly are the same dimensions.

As defined herein, "support stem" refers to a unit which may be positioned between one or more product packages in a product display assembly. The support stem may provide the benefit of an additional degree of stability to a product display assembly because it may prevent product packages from shifting relative to each other. In one embodiment a support stem comprises an x-direction, y-direction, z-direction, y-z plane, x-y plane and x-z plane. In the exemplary embodiment, the support stem has a relatively high area in the x-y plane and may be relatively thin in the z-direction. In one embodiment, the support stem is from about 1 ft to about 8 ft in the x-direction. In another embodiment, the support stem is from about 3 ft to about 5 ft in the x-direction. In one embodiment, the support stem is 1 ft to about 8 ft in the y-direction. In another embodiment, the support stem is from about 3 ft to about 5 ft in the y-direction. In one embodiment, the support stem is from about 1 inch to about 10 inches in the z-direction (thickness). In another embodiment, the support stem is from about 2 inches to about 6 inches in the z-direction. In one embodiment, the support stem is rectangular in the x-z plane and has small feet, or some other vertical balance and/or support mechanism to "stand" the support stem on a base.

As defined herein, "flap" refers to at least one portion of a foldable pallet cover which may contain one or more visual elements. In one embodiment, a flap is mechanically attached to a support stem at the top-side of the support stem (i.e., the end in the +z direction of the support stem). In another embodiment, a flap is hingedly attached to the support stem such that the flap is foldable about the intersection between the flap and the support stem (i.e., the hinge.)

As defined herein, "adhesive" refers to a composition which demonstrates connection when applied to another material or composition generally (e.g. material is not specially selected). Adhesive compositions connect to other materials or compositions generally and no particularly selected properties of the other material or composition are necessary to demonstrate a general tendency to adhere.

As defined herein, "cohesive" refers to a material which demonstrates surface interaction (in terms of connection of one surface to another) when applied to a specially selected material. An A-A type cohesive material will fasten or form a connection primarily to itself or to similarly structured materials. Generally, such materials are substantially non-tacky (such as to skin) at room temperature even under some pressure. An A-B type cohesive material demonstrates surface interaction properties where material A will stick to different material B. However, A may also attach to A and B may attach to B. An A-B type cohesive system could also exist where type A material may attach to material of type A or type B, but the B type material will not attach to itself or other materials other than A. Materials which are designed to receive (i.e. allow the surface interaction) with a particular cohesive material, but which themselves will not connect with any other materials (or itself) are still considered "cohesive materials" within the meaning of this specification when they act as the target surface for a specific cohesive engaging material.

In one embodiment the support stem further comprises one or more flaps which may extend beyond the maximum height boundary of the product space. In one embodiment the flaps are fold-able such that the flaps may be positioned to be flush with the product packages. Without wishing to be limited by theory, it is thought that by providing such foldable flaps, the product display assembly may be easily provided with an overwrap and impart an additional degree of stability to the product display assembly during transport. Further, upon removal of the overwrap and set-up in the retail location, the flaps may be extended above the maximum height boundary to provide for a visual element to the product display assembly.

Product Display Assembly

FIG. 1A shows a perspective view of an exemplary product display assembly 10 of the present invention. The product display assembly comprises an x-direction, y-direction, and z-direction and x-z, x-y, and y-z planes. The product display assembly 10 comprises one or more, or a plurality of, product packages 20. The product packages 20 are supported on a base 30. In one embodiment the base is a pallet. The plurality of product packages 20 comprise a maximum length boundary, $L_{max}$, maximum width boundary, $W_{max}$, and maximum height boundary, $H_{max}$. The space that the product packages occupy (i.e., $L_{max}$, $W_{max}$ and $H_{max}$) may be referred to as the product space 22 of the packages.

In the exemplary embodiment the product display assembly 10 further comprises a support stem 40. In the exemplary embodiment, the support stem 40 may be positioned between two or more product packages 20. One of skill in the art will appreciate that the support stem 40 may be positioned at the end, or edge, of the product space 22. The support stem 40 may further comprise one or more flaps 42. The flaps 42 may be a continuation of the support stem 40, or may be a separate component from the support stem 40 that is hingedly attached to the support stem 40. In the exemplary embodiment the flaps 42 are foldable about the point of connection between each flap 42 and the support stem 40 such that the body of the flaps 42 may rest upon the top x-y plane of the product space 22 during transport, and the flaps 42 may be extended above the maximum height boundary $H_{max}$ upon arrival, and display in, a retail location. Without wishing to be limited by theory, it is thought that by providing a support stem 40 and/or foldable flaps 42, the product display assembly will be provided with additional levels of stability for the product display assembly 10 during transport and while the product display assembly 10 is on display in the retail location.

In addition, the foldable flaps 42 that may extend beyond the width, length and/or height boundaries of the product space 22 and/or product display assembly 10 may provide producers of products the opportunity to include additional information, advertising, or visibility to the product display assembly 10. As described supra a flap refers to at least one portion of a foldable pallet cover which may contain one or more visual elements. Without wishing to be limited by theory, it is thought that there can be a significant cost savings provided to product manufacturers and producers by reusing a pallet cover as a part of a product display assembly 10 rather than discarding a pallet cover and providing an additional product display member.

One of skill in the art will appreciate that although FIG. 1A represents that the largest area of the support stem 42 is planar with the x-z plane, the support stem 40 may be juxtaposed in any orientation relative to the x, y, and z-axes. One of skill in the art will also appreciate that the juxtaposition of the support stem 40 is highly dependent on the size, shape, and relative orientation of the product packages 20. Further, the support stem may be any size that is suitable for the desired application. For example, in one embodiment the support stem 40 may have an x-z plane (support stem face) area that is the same as the x-z area occupied by the product packages 20 (product package face area). In another embodiment, the support stem may have a face area that is smaller than the product package face area. In another embodiment still, the support stem may have a face area that is larger than the product package face area. In other words, the support stem may extend beyond the maximum length, maximum width and/or maximum height boundary of the product space 22.

Figure 1B:
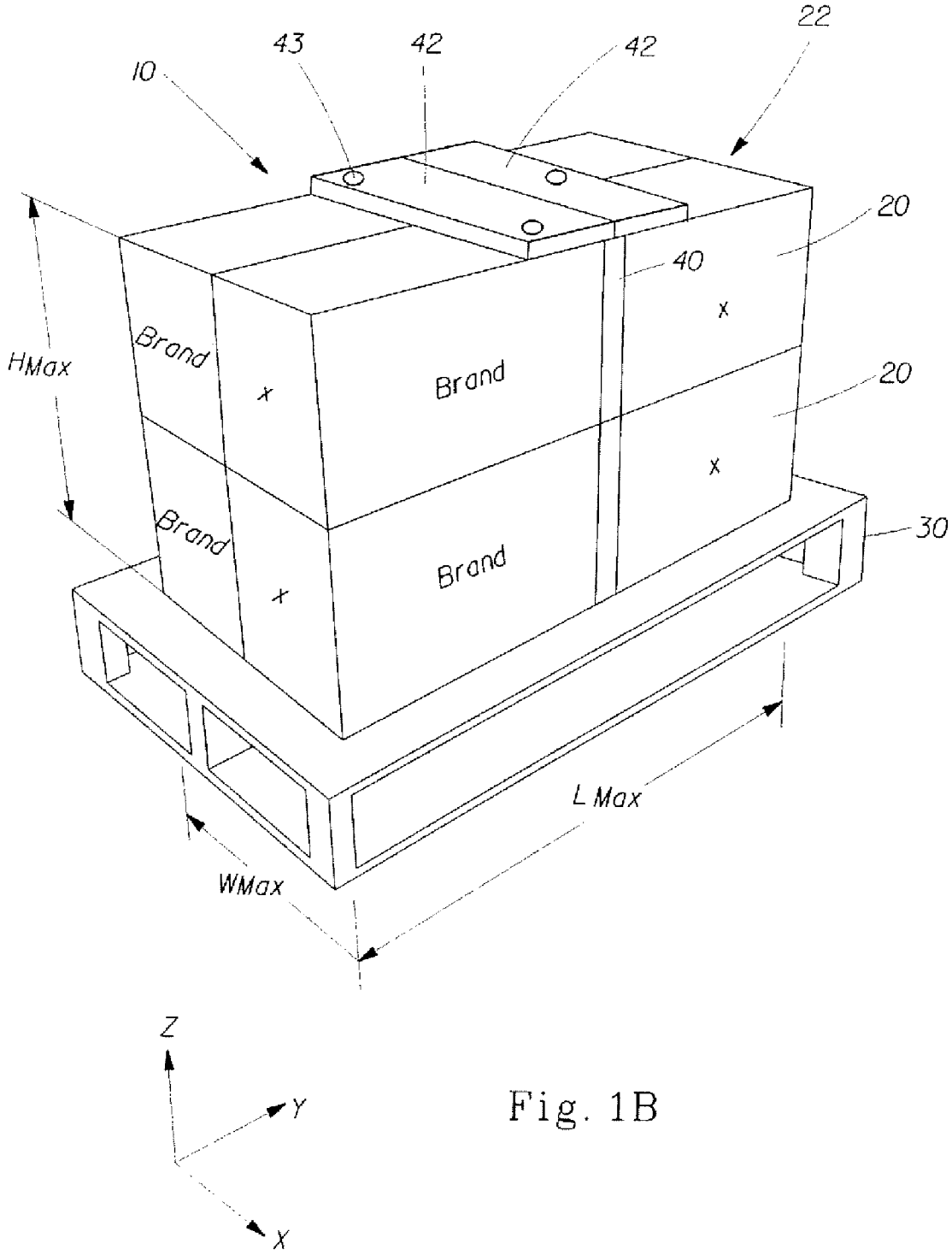
FIG. 1B is a perspective view of an exemplary product display assembly according to the present invention.

FIG. 1B shows the product display assembly of FIG. 1A wherein the flaps 42 have been folded to be planar with the x-y plane of the product space 22. In the exemplary embodiment of FIG. 1B the flaps 42 have been provided with an adhesive 43 such that the flaps 42 may be adhered allowing the flaps 42 to remain extended above the product space 22 as is shown in FIG. 1A. In the exemplary embodiment, the adhesive 43 is applied to the center-facing side of the flaps 42 of the support stem 40 as opposed to the consumer-facing side such that one flap 42 may be bonded to an adjacent flap 42.

In one embodiment, the adhesive 43 is covered by a removable layer that facilitates the application of adhesive at the user's leisure. One of skill in the art will appreciate that any appropriate fastening means that is known in the art may be used to fasten one or more flaps 42 together. For example, a mechanical fastener such as a snap may be used. In another embodiment, one or more magnets may be used.

Figure 1C:
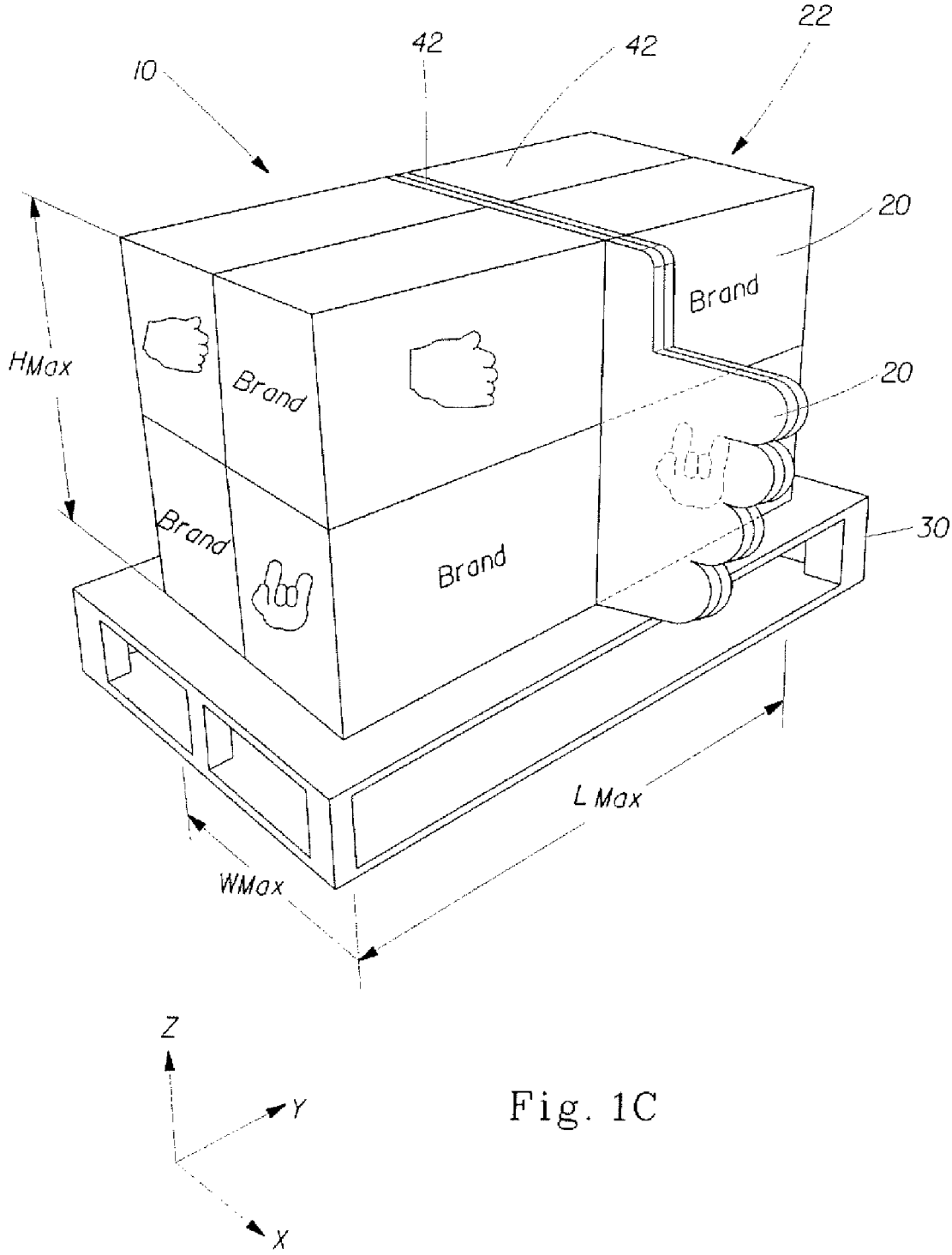
FIG. 1C is a perspective view of an exemplary product display assembly according to the present invention.

FIG. 1C shows a perspective view of an exemplary product display assembly wherein the flaps 42 extend beyond the maximum width boundary of the product space 22. One of skill in the art will appreciate that the flaps 42 may extend beyond any maximum length, width, and/or height boundary of the product space 22.

Support Stem

Figure 2A:
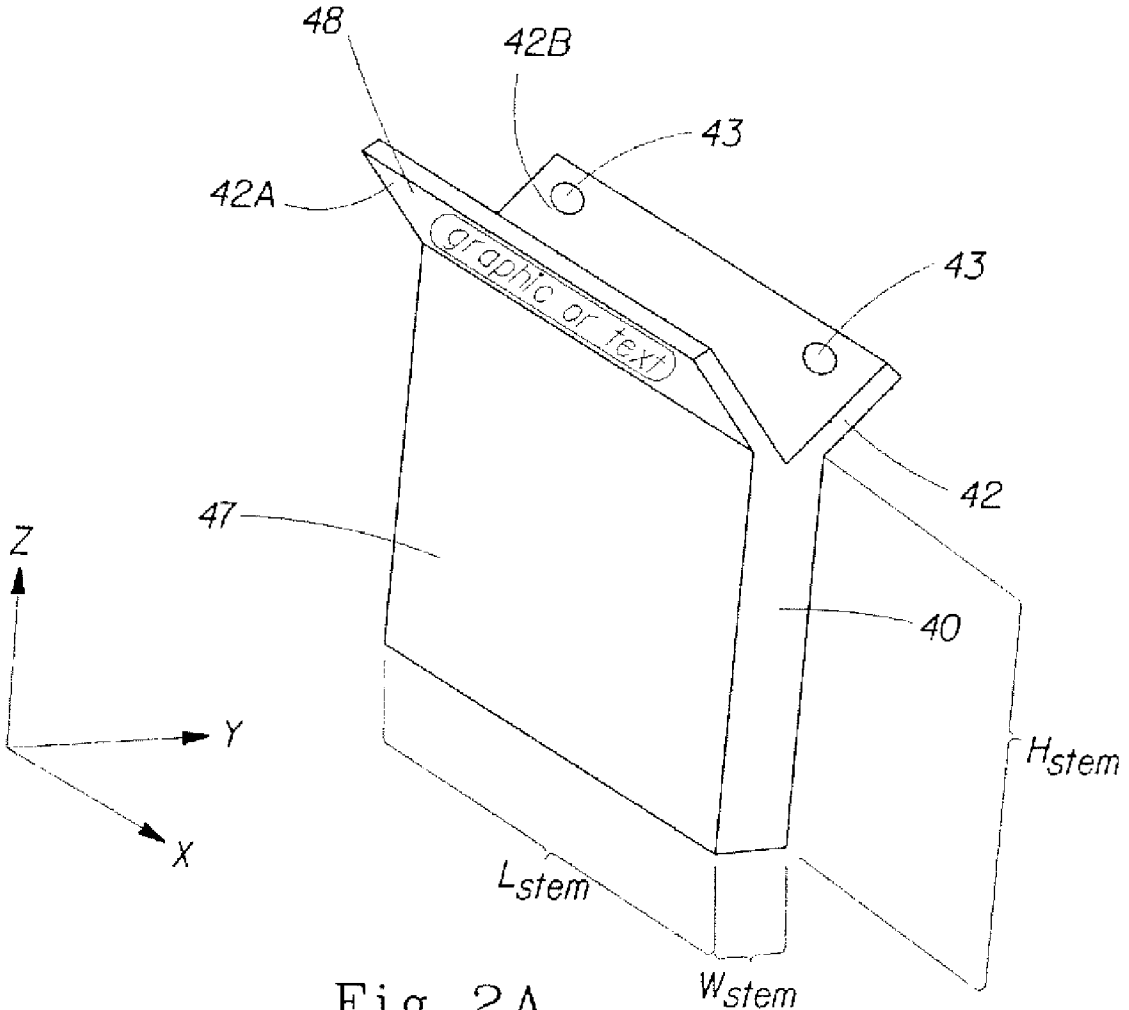
FIG. 2A is a perspective view of an exemplary support stem according to the present invention.

FIG. 2A shows a perspective view of an exemplary support stem 40. In the exemplary embodiment, the support stem 40 has an x-axis, y-axis, z-axis and comprises a support stem face 47 in the x-z plane. The support stem 40 further comprises one or more hingedly attached flaps 42. As disclosed supra, the flaps 42 may be foldable to provide for ease in transport. In one embodiment, the flaps 42 are foldable and may be extended such that they are substantially coplanar with the x-z plane (face) of the support stem 42.

In one embodiment the flaps 42 may have adhesive 43 or some other fastening or bonding means (for example, cohesive, Velcro™, snaps, the like, and combinations thereof) disposed on the inner surface 42B of the flap 42 and one or more visual elements 48 on the outer surface 42A of the flap. Without wishing to be limited by theory, it is thought that by fastening or bonding two or more flaps 42 together, the flaps 42 will be rigid and extend above the product space (FIGS. 1A-C) when in a retail location. A visual element 48 may be selected from the group consisting of: logos, trademarks, sayings, slogans, pictures, character renditions, photographs, product samples, product representations, holograms, shapes, words, letters, the like, and combinations thereof. The support stem 40 further comprises a stem width, $W_{stem}$, stem length, $L_{stem}$, and stem height, $H_{stem}$.

Figure 2B:
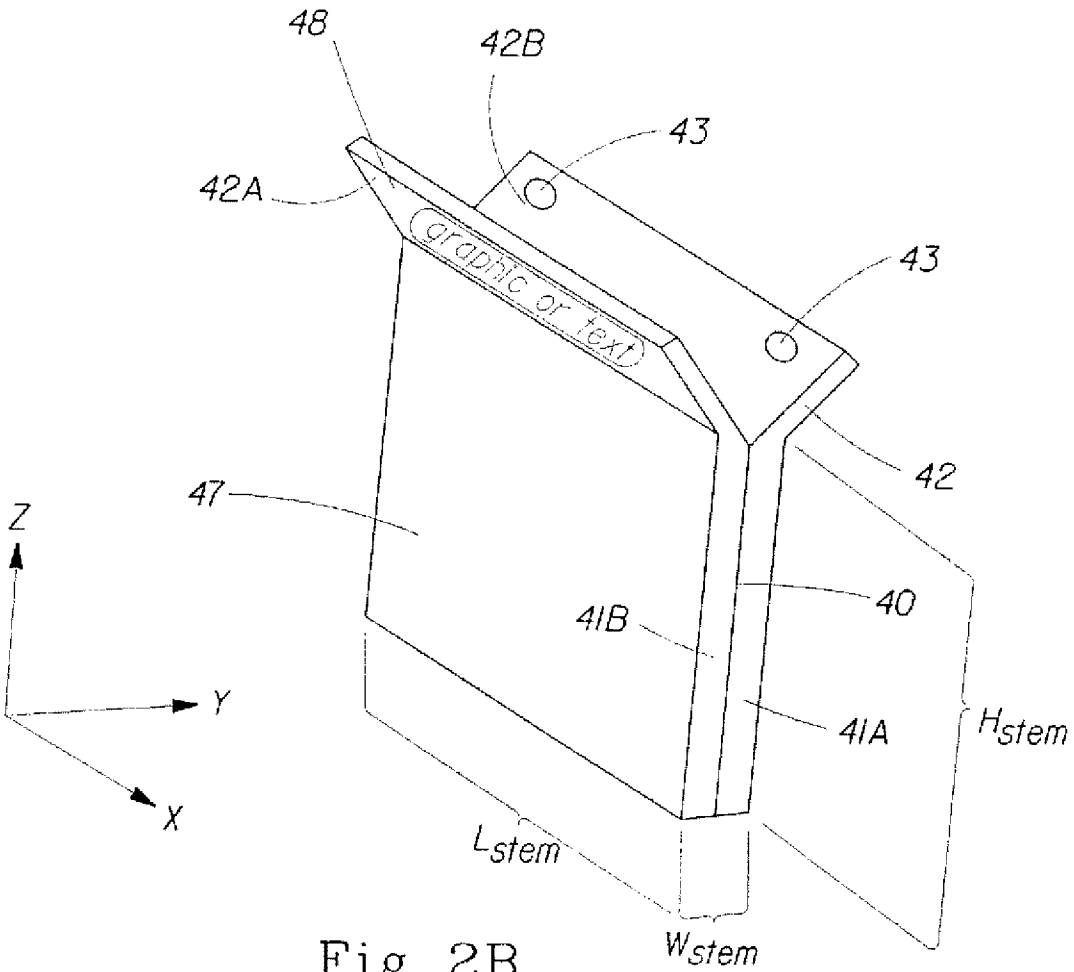
FIG. 2B is a perspective view of an exemplary support stem according to the present invention.

FIG. 2B shows an exemplary support stem 40 wherein the support stem 40 comprises two separate pieces 41A, B which have been attached to each other. One of skill in the art will appreciate that a support stem 40 may be comprised of any number of separate pieces 41A, B and the flaps 42 may be extensions of those separate pieces 41A, B.

Figure 2C:
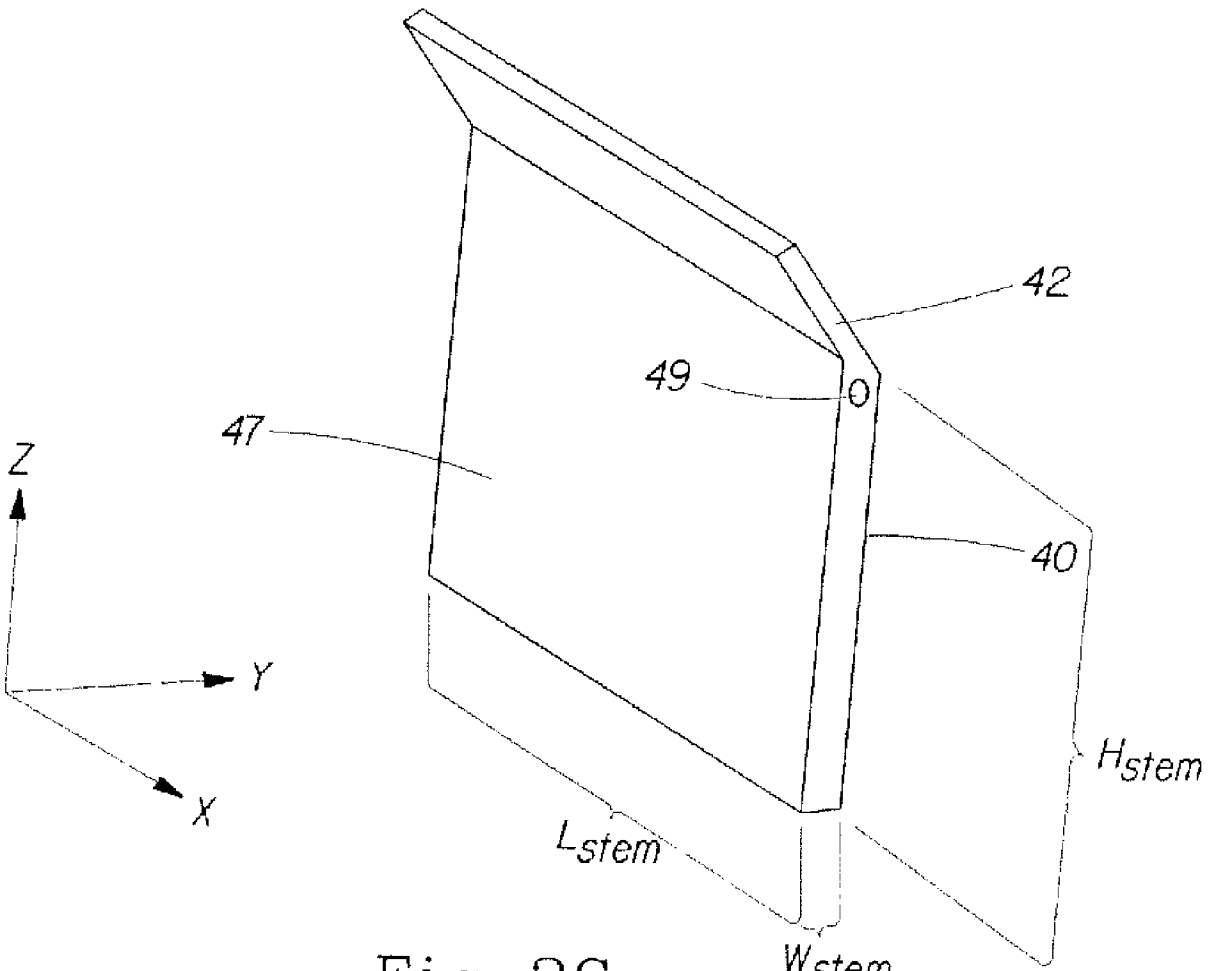
FIG. 2C is a perspective view of an exemplary support stem according to the present invention.

FIG. 2C shows an exemplary support stem 40 wherein the support stem 40 comprises a single flap 42. The support stem 40 may optionally comprise a mechanical mechanism 49 that may be used to secure the flap 42 in a horizontal, vertical or some other configuration. An example of a suitable mechanical mechanism 49 is a locking hinge.

Figure 3:
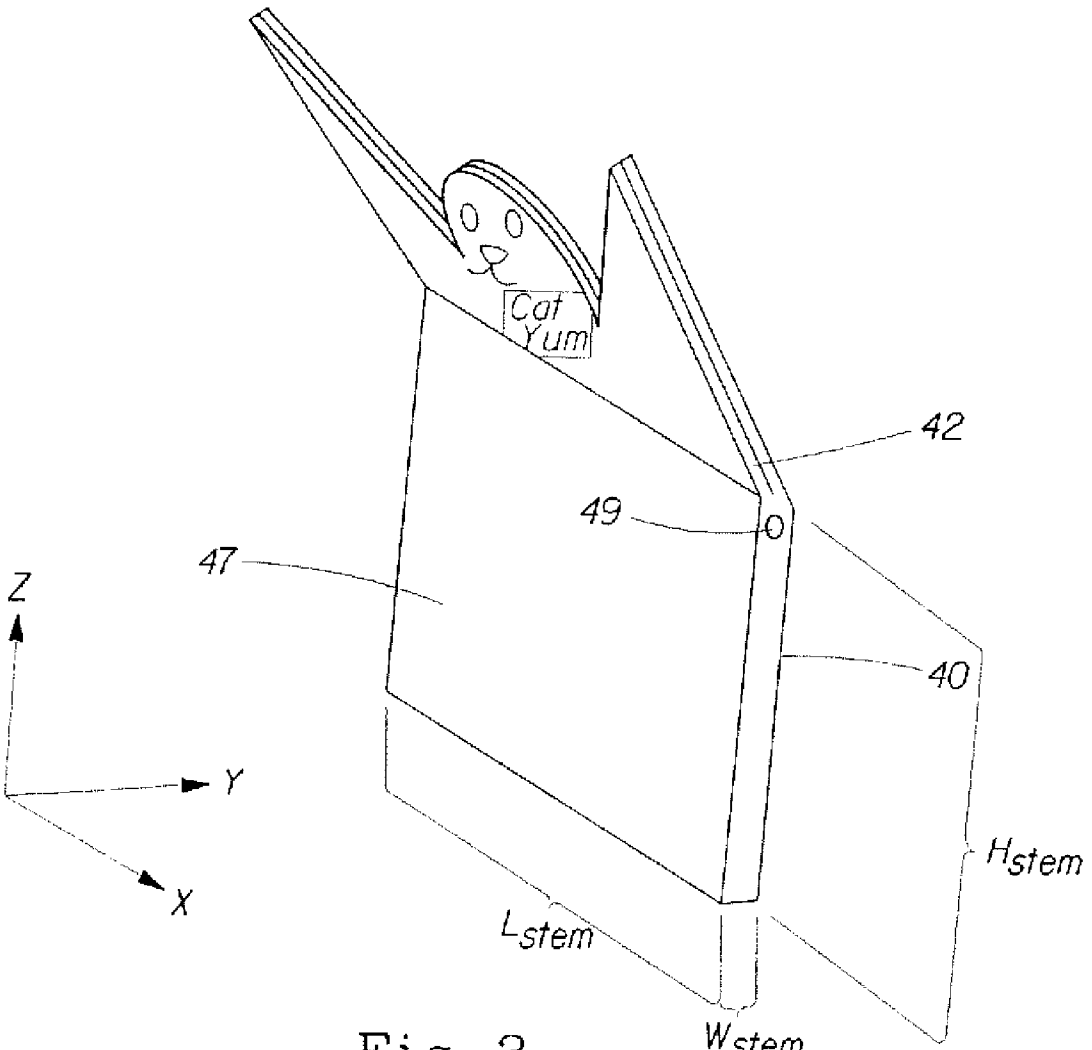
FIG. 3 is a perspective view of an exemplary support stem according to the present invention.

FIG. 3 shows an exemplary support stem 40 wherein the support stem comprises two flaps 42 which are in an irregular shape. One of skill in the art may appreciate that the flaps 42 may comprise any shape that is suitable for the desired product being sold and application. In one embodiment, a flap 42 may have a geometric shape, such as a square, semicircle, circle, oval, rectangle, octagon, the like, and combinations thereof. In another embodiment, a flap 42 may be a nongeometric shape. For example, the flaps 42 may take the shape of the profile of a product mascot, such as a cat, dog, or bear.

Further, a support stem may comprise multiple flaps 42 wherein the flaps have the same shape, or the flaps may have different shapes.

Nonlimiting examples of materials from which the support stem may be constructed include, but are not limited to: metal, wood, plywood, corrugated cardboard, plastic, the like, and combinations thereof.

Base

In one embodiment of the invention, the base is a pallet. Exemplary pallets are described in U.S. Pat. Nos. 4,413,737 and 5,582,113. The base may have dimensions of from about 25" (0.635 m) to about 65" (1.651 m) in width. In another embodiment of the invention, the base is from about 30" (0.762 m) to about 60" (1.524 m) in width. In yet another embodiment of the invention, the base is from about 40" (1.016 m) to about 50" (1.27 m) in width. In one embodiment of the invention, the base is from about 20" (0.508 m) to about 60" (1.524 m) in length. In another embodiment of the invention, the supporting medium is from about 25" (0.635 m) to about 55" (1.397 m) in length. In yet another embodiment of the invention, the supporting medium is from about 30" (0.762 m) to about 45" (1.143 m) in length.

Figure 4:
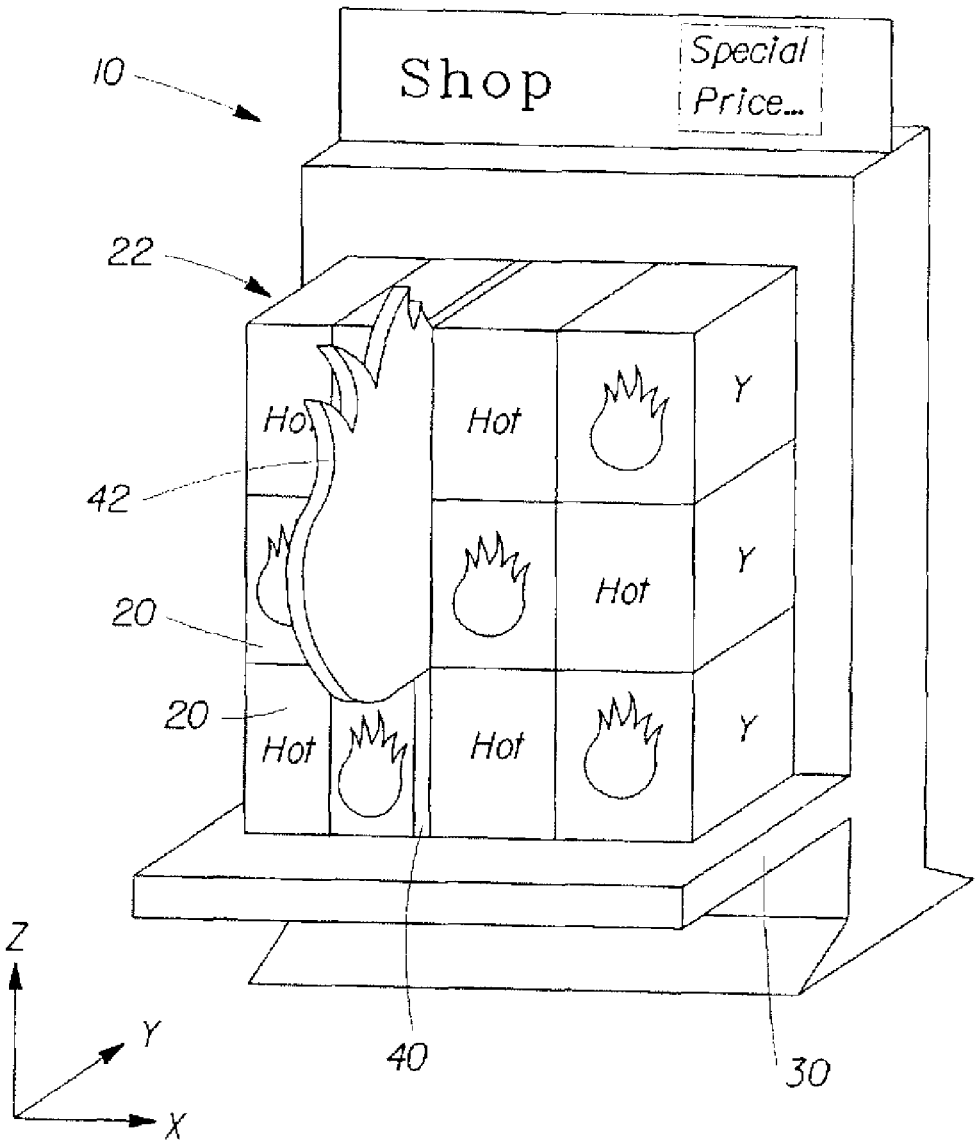
FIG. 4 is a perspective view of an exemplary product display assembly according to the present invention.

In another embodiment, the base is a retail shelf assembly. FIG. 4 shows a perspective view of an exemplary embodiment of a product display assembly 10 wherein the base 30 is a retail shelf. The plurality of packages 20 is supported on the base 30 which is a shelf. In the exemplary embodiment, the plurality of packages 20 is provided with the support stem 40 having one or more flaps 42. Upon arrival of the packages 20 and support stem 40 at the retail location, it is thought that the retailer may simply transport the packages to a base 30, such as a shelf or any other suitable display space, then remove any outerwrap or covering and the product display assembly 10 is ready for easy set-up.

Figure 5:
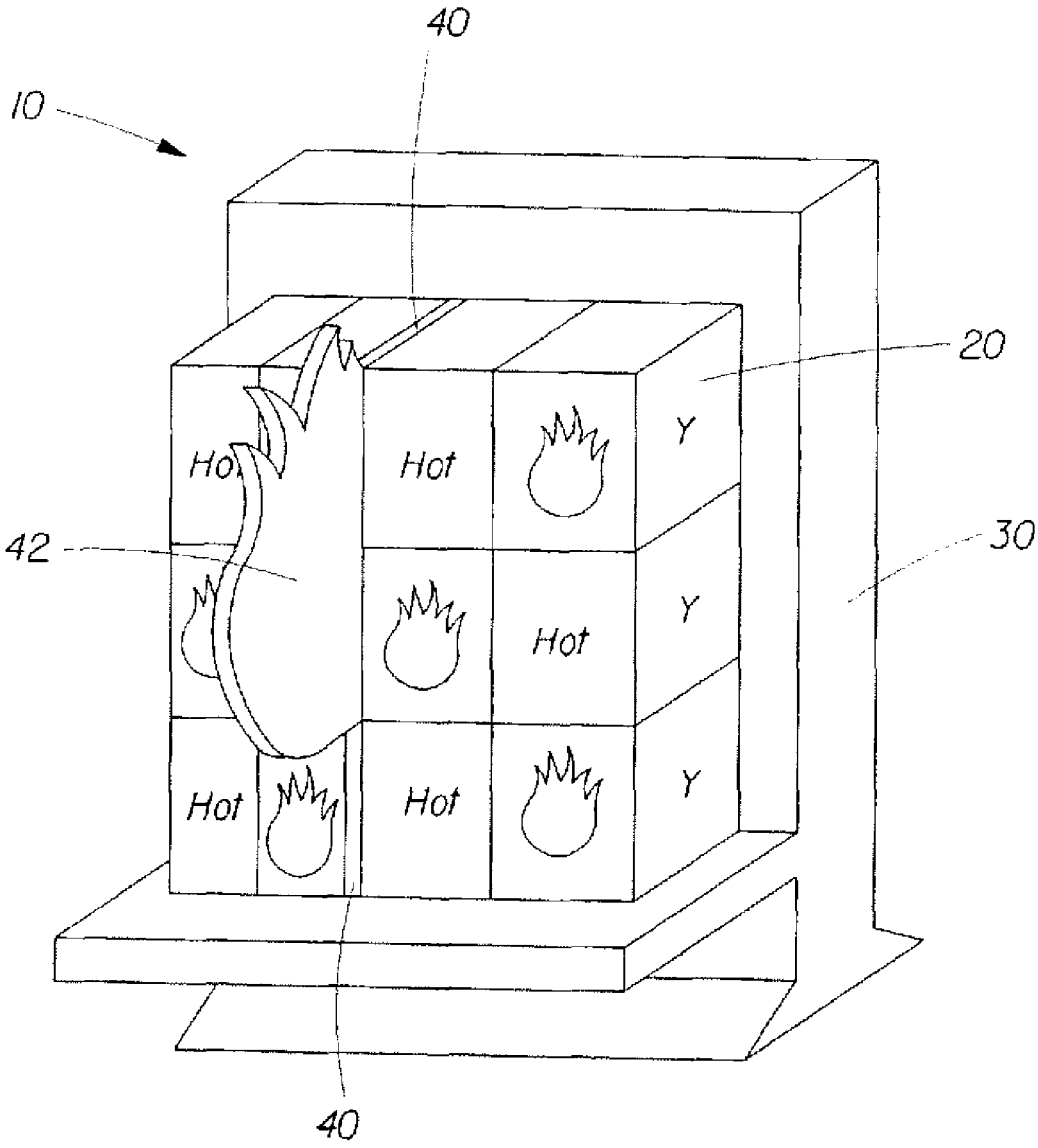
FIG. 5 is a perspective view of an exemplary product display assembly according to the present invention.

In still another embodiment shown in FIG. 5 the product display assembly 10 may be provided wherein the base 30 is a disposable display unit that is provided by the manufacturer to the retailer. In the exemplary embodiment the plurality of packages 20 is supported on the base 30 which is a disposable display unit provided by the manufacturer. In the exemplary embodiment, the plurality of packages 20 is provided with the support stem 40 having one or more flaps 42. Upon arrival of the packages 20 and support stem 40 at the retail location, it is thought that the retailer may simply remove any overwrap and the product display assembly 10 is ready for easy set-up. A further advantage of the exemplary product display assembly 10 is that the manufacturer may preload the base 30 with the packages 20 and support stem 40 having one or more foldable flaps 42 and overwrap the product display assembly 10 for transport, and set-up (i.e., extension of the one or more flaps 42) at a retail location.

Support Stem with Feet

Figure 6:
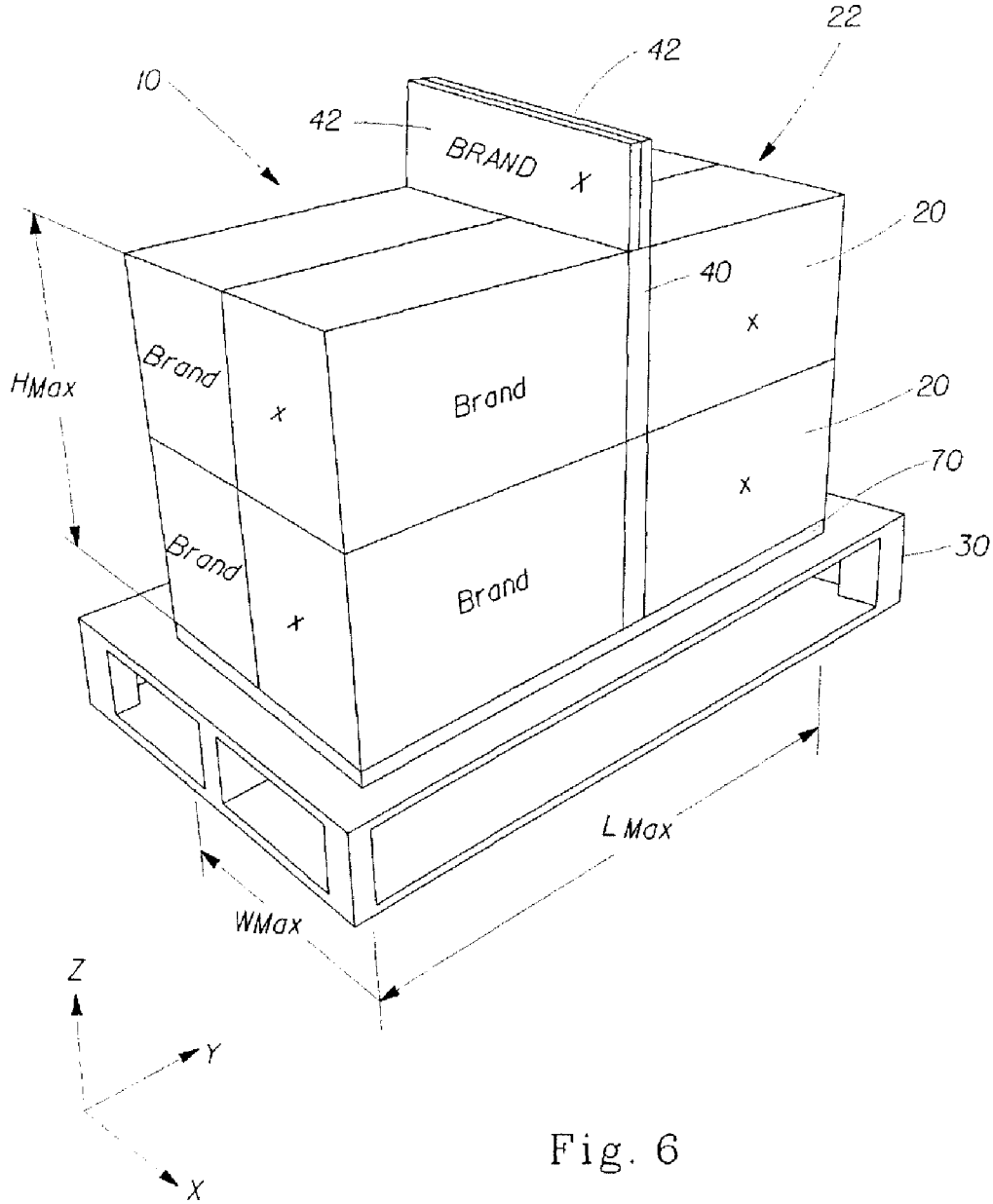
FIG. 6 is a perspective view of an exemplary product display assembly according to the present invention.

FIG. 6 shows an exemplary embodiment of a product display assembly 10 having a base 30 and a plurality of product packages 20 supported thereon. The exemplary product display assembly 10 further comprises one or more feet 70. While it is optional for the support stem to comprise feet 70, it is thought that the inclusion of an element that may provide a supporting mechanism for the support stem 40 provides the benefit of allowing consumers to remove product packages 20 from the product display assembly 10 without causing the support stem 40 to fall over or otherwise tip over. Any mechanism known in the art may be used to act as feet 70 or supporting mechanism to help stabilize the support stem 40.

Figure 7:
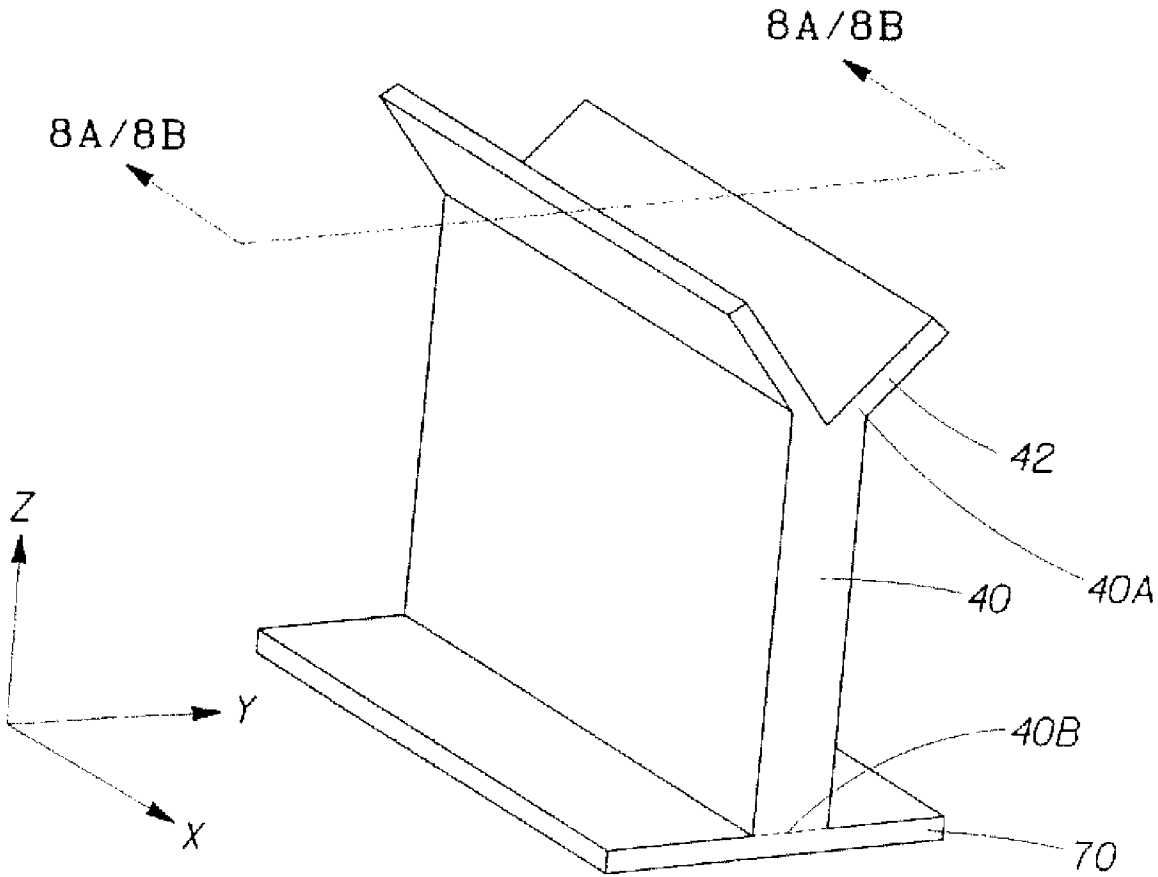
FIG. 7 is a perspective view of an exemplary support stem according to the present invention.

FIG. 7 shows an exemplary embodiment of a support stem 40 wherein the support stem 40 has a top side 40A and a bottom side 40B and the support stem 40 further comprises feet 70. The feet 70 may be provided at the bottom side 40B with such dimensions that a support stem 40 comprising feet 70 and one or more flaps 42 located at the top side 40A is self-supporting—in other words, the support stem may be maintained in the x-z plane without requiring being supported between two or more packages. In one embodiment the one or more feet occupy the entire area underneath the product space (22, FIG. 6), but may occupy any suitable area underneath the product space. One of skill in the art will appreciate that suitable area is dependent on a number of variables including product package size/configuration.

Figure 8A:
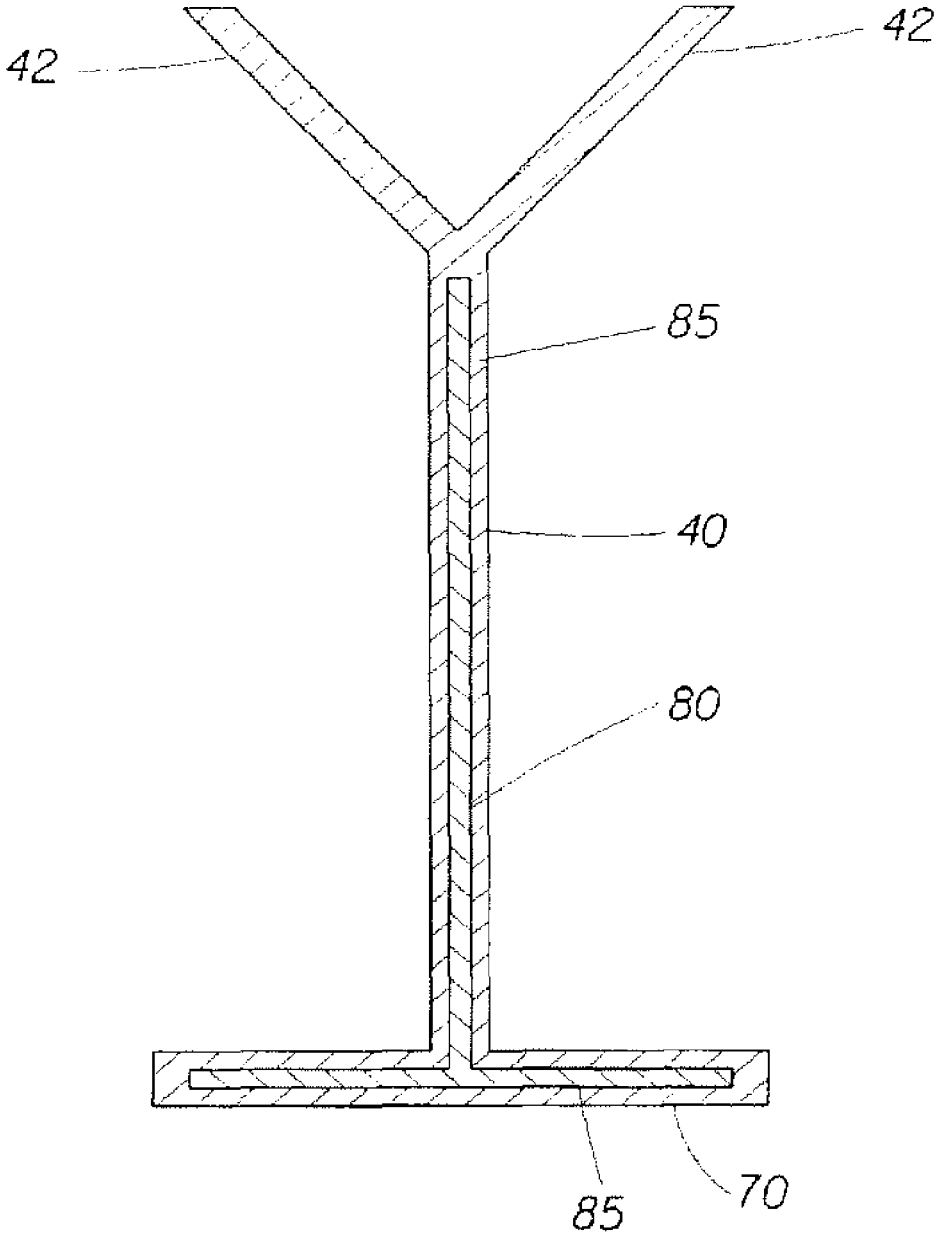
FIG. 8A is a cross-sectional view of the exemplary support stem according to FIG. 7 taken along the line 8A-8A.

FIG. 8A is an exemplary embodiment of a cross-sectional view of the support stem of FIG. 7 taken along the line 8A-8A. In the exemplary embodiment the support stem 40 and feet 70 comprise an optional reinforcement frame 85 which may be used to provide additional stiffness and/or rigidity to the support stem 40 and/or feet 70. In one embodiment only the feet have a reinforcement frame 85. In another embodiment only the support stem has a reinforcement frame 85. In another embodiment the reinforcement frame 85 is a continuous member that extends through the support stem 40 and feet 70.

Figure 8B:
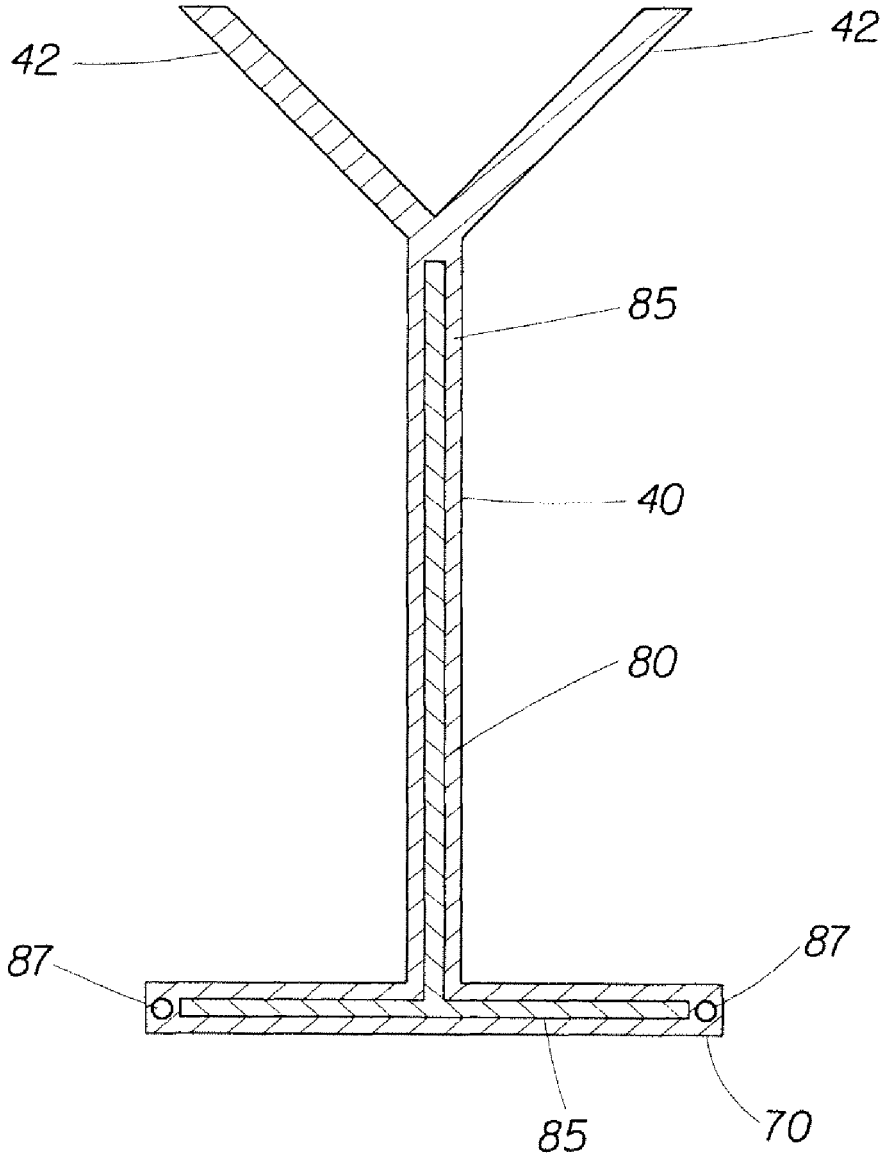
FIG. 8B is a cross-sectional view of the exemplary support stem according to FIG. 7 taken along the line 8B-8B.

FIG. 8B is an alternative exemplary embodiment of a cross-sectional view of the support stem of FIG. 7 taken along line 8B-8B. Again, the exemplary embodiment the support stem 40 and feet 70 comprise an optional reinforcement frame 85 which may be used to provide additional stiffness and/or rigidity to the support stem 40 and/or feet 70. In addition, the feet 70 may further comprise optional weight members 87 which may be used to provide additional stability to a support stem 40 that further comprises feet 70. The weights may be positioned at any place in and/or on the feet 70.

Figure 9A:
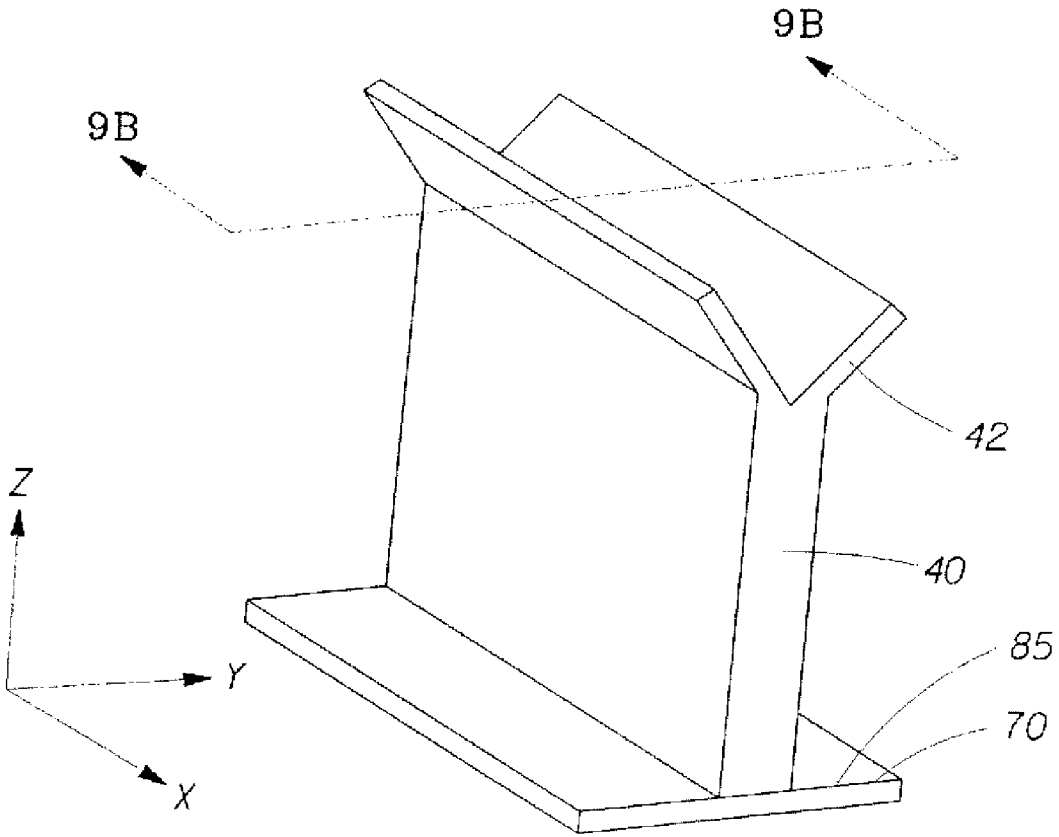
FIG. 9A is a perspective view of an exemplary support stem according to the present invention.
Figure 9B:
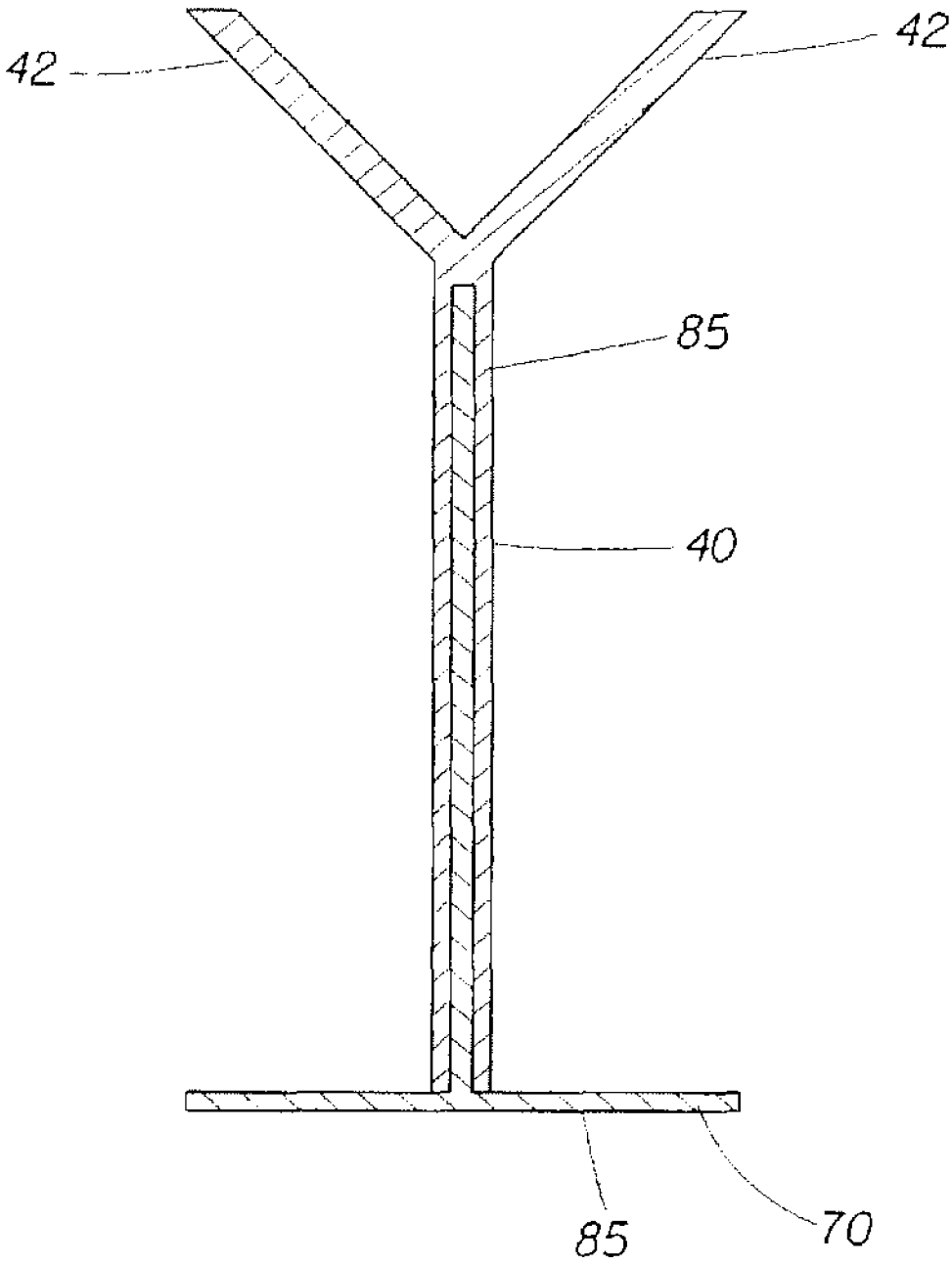
FIG. 9B is a cross-sectional view of the exemplary support stem according to FIG. 7 taken along the line 9B-9B.

FIG. 9A is an alternative exemplary embodiment of a support stem 40 comprising feet 70. In the exemplary embodiment, the reinforcement frame 85 is actually forms the feet 70. FIG. 9B is a cross-sectional view of the embodiment of FIG. 9A taken along the line 9B-9B. In this embodiment the reinforcement frame 85 is a continuous member that is disposed within the support stem 40 and extends beyond the bottom of the support stem to serve as feet 70.

A reinforcement frame 85 may be comprised of a plurality of rods, bars, poles, shafts, dowels, the like, and combinations thereof. A reinforcement frame may be constructed from any material including metal, wood, plywood, corrugated cardboard, plastic, the like, and combinations thereof. A reinforcement frame may have any dimensions suitable for the desired application. Again, one of skill in the art will appreciate that specific geometries of a reinforcement frame will depend on the size and/or configuration of the product packages.

Figure 10A:
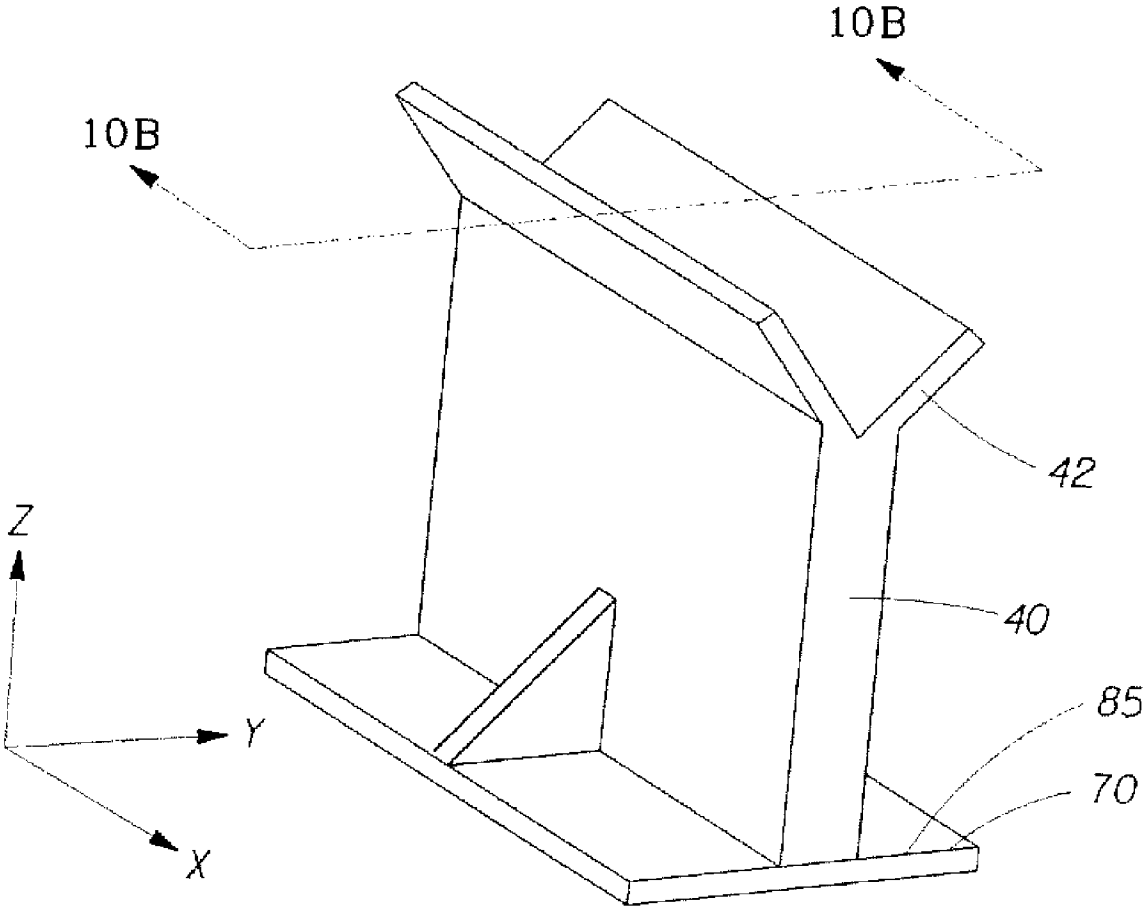
FIG. 10A is a perspective view of an exemplary product display assembly according to the present invention.

FIG. 10A is an alternative embodiment of a support stem 40 comprising feet 70. In the exemplary embodiment of FIG. 10A the support stem 40 further comprises one or more lateral balance members 75. Without wishing to be limited by theory it is thought that providing a balance member 75 in the y-z plane (i.e., attached a foot in the x-y plane and the support stem 40 in the x-z plane) will improve stability of the support stem 40 when the support stem 40 is used in a product display assembly. Additionally, it is thought that by providing a relatively thin (in the x-direction) balance member in the y-z plane there will be minimal interference with the placement of product packages in a product display assembly. The balance member 75 may be any shape or size that is suitable for the given application. In one embodiment a balance member 75 may be a shape selected from the group consisting of: triangles, squares, rectangles, parallelograms, semi-parallelograms, semicircles, circles, ovals, semi-ovals, the like and combinations thereof. A balance member be constructed from any material including metal, wood, plywood, corrugated cardboard, plastic, the like, and combinations thereof.

Figure 10B:
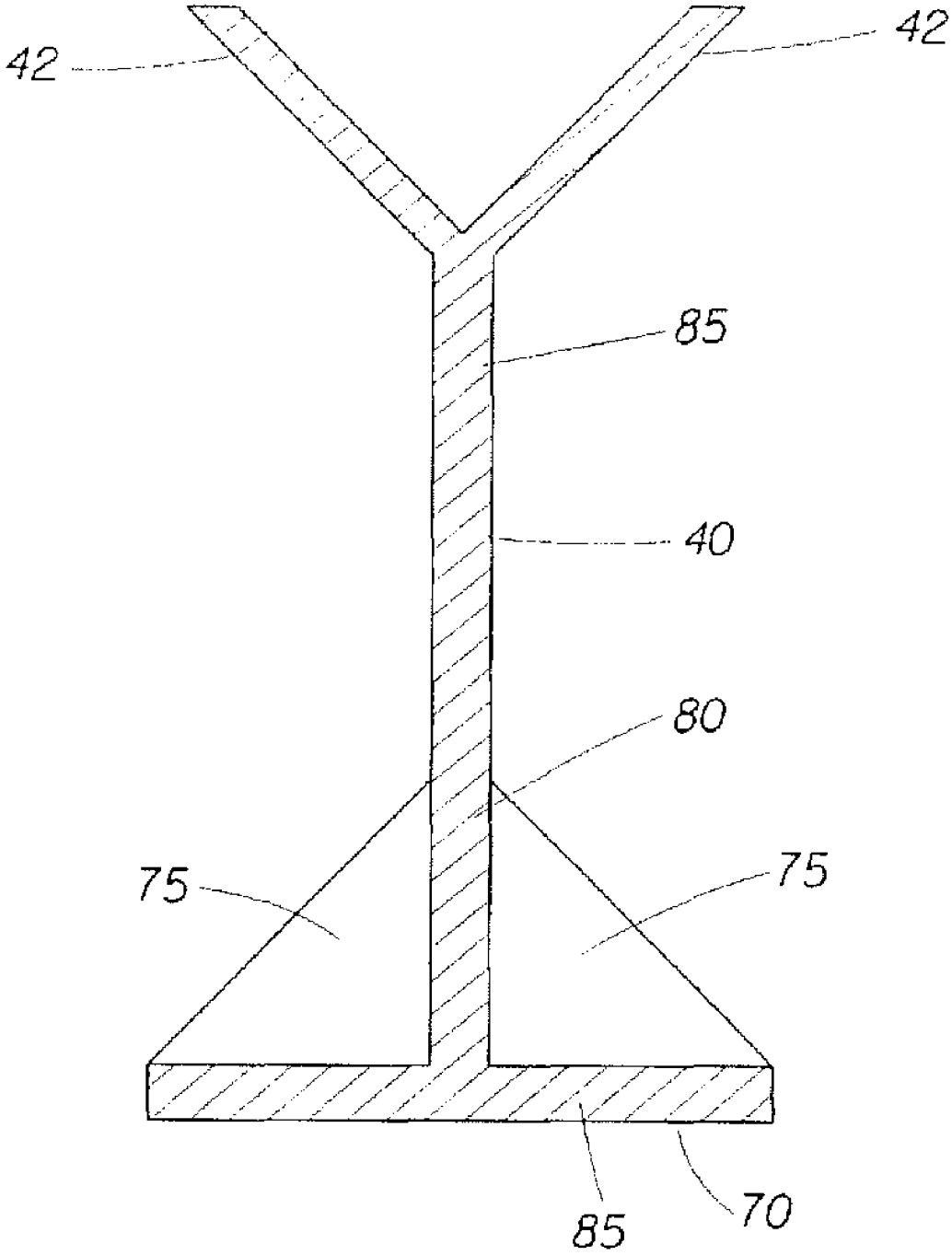
FIG. 10B is a cross-sectional view of the exemplary support stem according to FIG. 10A taken along the line 10B-10B.

FIG. 10B is a cross sectional view of the exemplary embodiment of the support stem 40 of FIG. 10A.

Pallet Cover

Figure 11A:
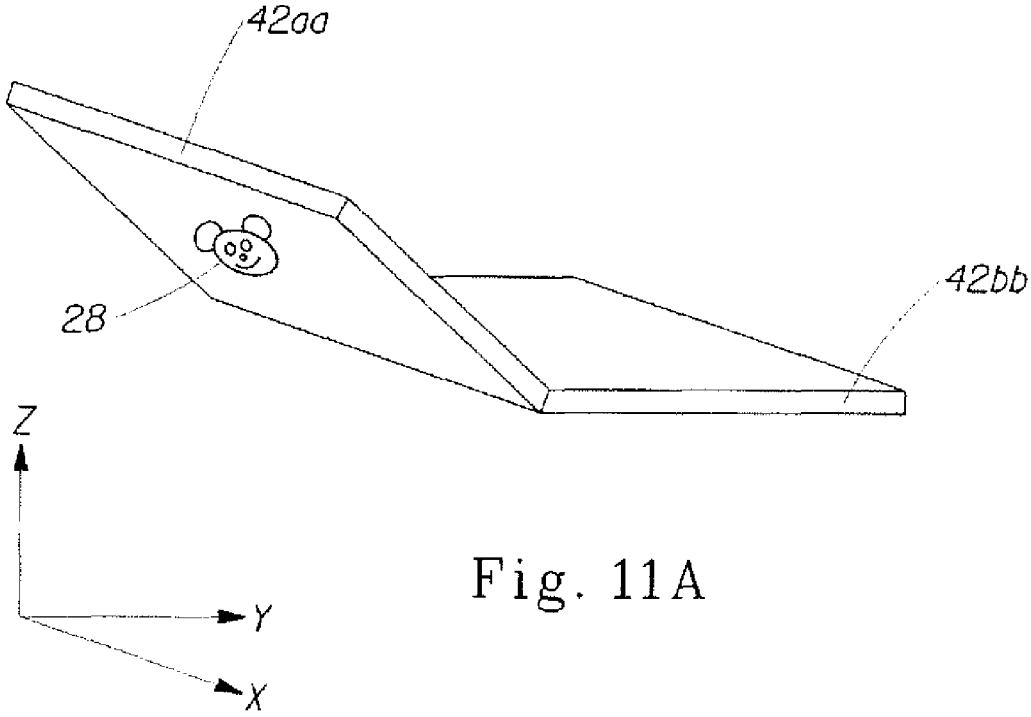
FIG. 11A is a perspective view of an exemplary pallet cover according to the present invention.

As described supra, some embodiments of the present invention may be used as a cost saving to the product manufacturer or producer. It is thought that such a cost saving may be achieved by providing FIG. 11A shows an exemplary embodiment of a pallet cover wherein the pallet cover comprises first flap 42*aa* hingedly attached to a second flap 42*bb*. In another embodiment, a pallet cover may comprise two or more hingedly attached flaps. One or more visual elements 28 may be printed, attached to, or otherwise disposed on one or more of the flaps 42*aa*, 42*bb*. It is thought that providing such a foldable configuration of flaps 42*aa*, 42*bb* the flaps may be laid flat (i.e., in the x-y plane) during transport to serve as a pallet cover and upon arrival at a retail location the flaps 42*aa*, 42*bb* may be extended to serve as a sign or other marketing tool. Without wishing to be limited by theory, it is thought that doing this may provide cost savings to the product manufacturer or producer. In one embodiment, the flaps may be attached to a support stem which is provided separately and then used in a product display assembly at a retail location.

Figure 11B:
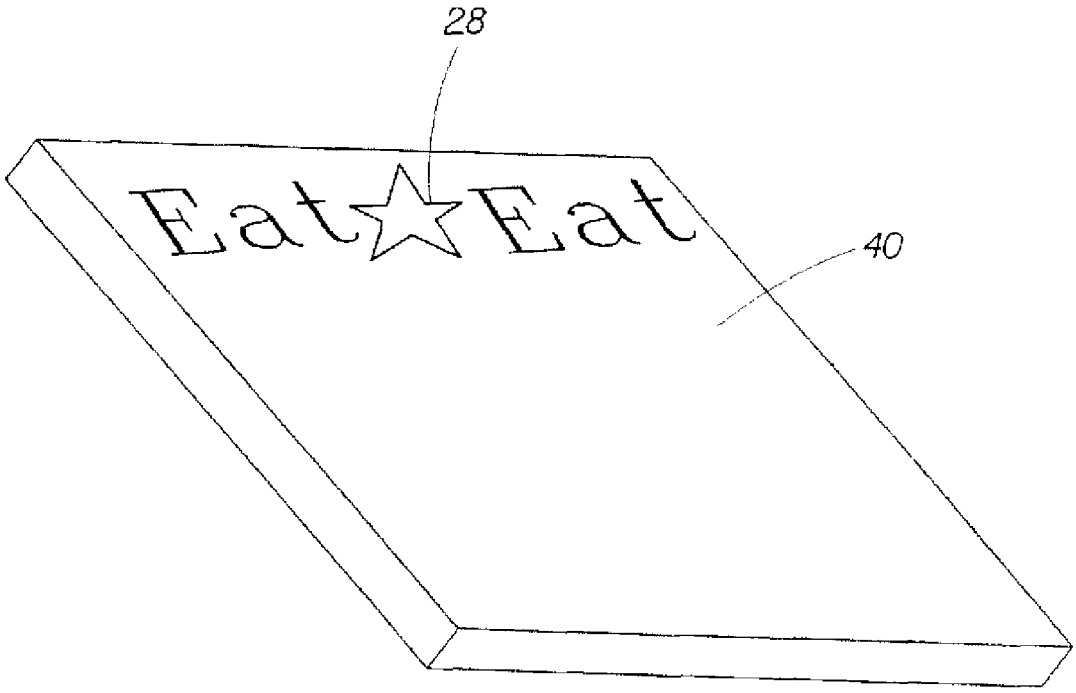
FIG. 11B is a cross-sectional view of the exemplary pallet cover according to FIG. 11A taken along the line 11B-11B.

FIG. 11B shows an exemplary alternative embodiment of a multi-purpose pallet cover. In this nonlimiting embodiment, the pallet cover may be reused as a support stem 40 wherein the support stem further comprises one or more visual elements 28. Without wishing to be limited by theory, it is thought that that the support stem 40 may be laid on top of an array of palletized product packages to act as a pallet cover during transport. Upon arrival at a retail location, it is thought that the support stem may then be wedged between product packages to serve as a means for support and/or sign or other visual signaling mechanism.

Transport and In-Store Set-Up

As described supra, it may be necessary for a producer of product to transport a product display assembly from a manufacturing or production facility to a retail location. For example, a product display assembly may need to be loaded onto a truck, transported across state or national borders, unloaded at a retail location, moved around within the retail location, and then placed on display at the retail location for sale to customers.

In order to facilitate the exemplary transport process, it may be advantageous to provide an outer covering to the product display assembly. In fact, one of skill in the shipping art will appreciate that such a process is commonly performed by either providing a crate for a plurality of product packages, or by providing an overwrap, or any other suitable physical constraint, to the product display assembly. An exemplary method and apparatus for providing an overwrap to a pallet assembly is described in U.S. Pat. No. 6,594,970. Further, it is thought that it is easiest to provide an outer covering if the product display assembly—especially the product space—conforms to a regular geometric figure with relatively flat surfaces, such as a rectangular prism or a cube.

By providing visual elements in the form of a foldable flap attached to a support stem, the inventors observe the unexpected benefit of being able to position the foldable flap(s) to be flush with the outer surface of the product space, thus providing a flat surface to make it relatively simple for an overwrap to be utilized.

It is also observed that a product display according to the present invention is more stable compared to a prior art palletized product wherein a plurality of packages are supported by only a base. Without wishing to be limited by theory, it is thought that the support stem provides stability to the plurality of packages. For example, by providing a support stem that is rigid in the x-z plane, it is surprisingly discovered that the packages is relatively more stable when subject to forces with an element normal to the x-z plane—despite the fact that the support stem is not mechanically integrated to the base, or pallet, itself.

Further, when unloaded at the retail location, a product display assembly according to the present invention may provide the advantage of being relatively easy to set up. In one embodiment, upon arrival at the retail location a product display assembly, a overwrapped product display assembly may be uncovered (i.e., the overwrap is removed from the product display assembly) and the foldable flaps, which may be configured to be flush with the product space during transport, may be folded and configured to extend beyond the product space with relative ease.

Without wishing to be limited by theory, it is thought that a product display assembly having minimal non-integrated componentry for set-up will encourage retailers to provide a complete set-up of the product display assembly. It is thought that by providing a product display assembly which is overly cumbersome to configure or which have an inordinate number of components to a retailer, the retailer may be discouraged from setting up such a complicated display and prefer to reuse an existing display from the same product. It is known to those of skill in the retail display arts that the complexity of certain product display assemblies often requires manufacturers to incur additional costs to ensure proper set-up of the product display assembly.

By providing a product display assembly having an integrated, easy to set-up visual component, which also provides the unexpected benefit of increased stability, it is thought that a manufacturer will be able to increase in-store compliance for set-up while reducing costs associated with in-store compliance.

Additionally, a product display assembly of the present invention is thought to be advantageous because the stems are self-supporting. In other words, the display remains intact despite the removal of product packages from the product display assembly. Without wishing to be limited by theory, it is thought that a disadvantage of a prior art display assembly wherein a signage or other visual element that is simply placed on top of a stack of product packages ex post facto is that the signage or other visual element will lose its visibility as product packages are removed from the display assembly.

Business Method

In one embodiment, an exemplary product display assembly of the present invention may be utilized as follows: In a first step, a base—such as a pallet—may be provided. In a second step, a plurality of product packages may be loaded, or otherwise provided, on the base or pallet. The plurality of product packages may define a product space. In a third step, a support stem may be provided to the assembly. As described supra, the support stem may be placed at any location suitable within the plurality of product packages, but in the exemplary embodiment, the support stem may be provided such that the body of the support stem is coplanar with the x-z plane (FIG. 1) and is between two or more product packages (FIG. 1). In the exemplary embodiment, the support stem further comprises one or more hingedly attached flaps that are extendable beyond the product space. In a fourth step, the pallet loaded with product packages and support stem may be provided with an outer wrap and/or overwrap. Without wishing to be limited by theory, it is thought that the outer wrap and/or overwrap is necessary to secure the product packages during transport. In some embodiments, overwrap may be provided to the base, or pallet, in addition to the product packages and support stem. Also as discussed supra, the flaps may be folded to be flush with the product space when provided with the outer wrap and/or overwrap. In a fifth step, the palletized product packages (i.e., product display assembly) may be transported by truck, or otherwise delivered in any appropriate manner known in the shipping arts, to a retail location for display.

In optional sixth and seventh steps (respectively), once at the retail location the outer wrap and/or overwrap may be removed from the product packages and/or product display assembly and, once the outer wrap and/or overwrap is removed, the flaps may be extended beyond the product space for display in the retail location.

It is noted that terms like "specifically," "preferably," "typically", "generally", and "often" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed:

1. A product display assembly, comprising:

a plurality of product packages supported by a base, wherein the plurality of product packages together define a product space; and a support stem having a portion thereof positioned between at least two of the plurality of product packages, the support stem comprising:

a body;

a first flap extending from the body and movable relative to the body;

a second flap extending from the body and being movable relative to the body and the first flap, wherein the first flap and the second flap each comprise visual indicia thereon, wherein the first flap and the second flap are together configured to form a display sign, and wherein the first flap and the second flap at least partially extend outwardly from the product space; and a foot comprising a weight.

2. The product display assembly of claim 1, wherein the first flap is configured to be attached to the second flap to form the display sign.

3. The product display assembly of claim 1, wherein the foot is a first foot, wherein the support stem comprises a second foot, wherein the first foot is attached to and extends from the body in a first direction, wherein the second foot is attached to and extends from the body in a second direction, and wherein the first direction is generally opposite to the second direction.

4. The product display assembly of claim 1, wherein the support stem comprises a locking hinge that is configured to permit pivotable movement of the first flap relative to the body.

5. The product display assembly of claim 1, wherein the body of the support stem comprises a first portion and a second portion, wherein the first flap and the second flap extend from the first portion, and wherein the foot extends from the second portion.

6. The product display assembly of claim 1, wherein the foot extends from the body in a direction generally perpendicular to a surface of the body, and wherein a portion of the product packages rest on the foot.

7. The product display assembly of claim 1, wherein the weight is configured to provide stability to the support stem.

8. The product display assembly of claim 1, comprising a base, wherein the base comprises one of a pallet, a retail shelf unit, and a shelf tray.

9. The product display assembly of claim 1, wherein the body comprises a reinforcement frame configured to provide structural support to the support stem.

10. The product display assembly of claim 1, wherein the support stem comprises a lateral balance member configured to engage a portion of two product packages.

11. The product display assembly of claim 1, wherein the support stem comprises a lateral balance member attached to the body and the foot.

12. The product display assembly of claim 1, wherein the plurality of products together define a shape that comprises a top surface and a side surface, and wherein the first flap and the second flap extend outside of the product space from the top surface or the side surface.

13. A product display assembly, comprising:

a pallet;

a plurality of product packages supported by the pallet, wherein the plurality of product packages together define a product space; and a support stem, comprising:

a body comprising a first end portion and a second end portion, wherein a portion of the body is positioned intermediate at least two of the plurality of product packages;

a first flap extending from the first end portion and movably attached to thereto;

a second flap extending from the first end portion, movably attached thereto, and being movable relative to the first flap, wherein the first flap and the second flap each comprise visual indicia thereon, wherein the visual indicia on the first flap forms a brand sign, and wherein at least a portion of the first flap and the second flap extend outwardly from the product space; and at least one foot extending from the second end portion, wherein the foot comprises a weight.

14. The product display assembly of claim 13, wherein the first flap comprises a first shape, wherein the second flap comprises a second shape, wherein the first shape is different than the second shape, and wherein the first flap is configured to be engaged with the second flap.

15. The product display assembly of claim 13, wherein the first flap comprises a first visual indicia, wherein the second flap comprises a second visual indicia, and wherein the first visual indicia is different than the second visual indicia.

16. A product display assembly, comprising:

a plurality of product packages configured to be positioned on a base, wherein the plurality of product packages together define a product space; and a support stem, comprising:

a body comprising a first end portion and a second end portion, wherein a portion of the body is positioned between at least two of the plurality of product packages;

a first flap extending from the first end portion, wherein the first flap is movable relative to the first end portion, wherein the first flap comprises visual indicia thereon, and wherein the first flap at least partially extends outwardly from the product space; and a locking hinge positioned between a portion of the first end portion of the body and a portion of the first flap, wherein the locking hinge is configured to permit movement of the first flap relative to the body.

17. The product display assembly of claim 16, wherein the support stem comprises:

a second flap extending from the first end portion; and a second locking hinge configured to permit movement of the second flap relative to the first end portion and the first flap.

18. The product display assembly of claim 16, wherein the support stem comprises a foot, wherein the foot extends in a direction generally perpendicular to a surface of the body, and wherein the support stem comprises a lateral balance member configured to be engaged with the body and the foot.

19. The product display assembly of claim 16, wherein the support stem comprises a foot, and wherein the foot comprises a reinforcing member and a weight.

20. The product display assembly of claim 16, wherein the support stem comprises:

a first foot attached to the second end portion of the body and extending in a first direction; and a second foot attached to the second end portion of the body and extending in a second direction, wherein the first direction is generally opposite to the second direction, but is generally parallel with the second direction.

* * * * *